United States Patent [19]

Knapp

[11] 4,417,780

[45] Nov. 29, 1983

[54] PITCH TRANSITION CONNECTOR

[75] Inventor: Robert E. Knapp, Covina, Calif.

[73] Assignee: Thomas & Betts Corporation, Raritan, N.J.

[21] Appl. No.: 381,130

[22] Filed: May 24, 1982

Related U.S. Application Data

[63] Continuation of Ser. No. 145,363, Apr. 30, 1980, abandoned.

[51] Int. Cl.[3] ..... H01R 13/38

[52] U.S. Cl. ..... 339/99 R

[58] Field of Search ..... 339/97 R, 97 P, 98, 339/99 R, 210 R, 210 M

[56] References Cited

U.S. PATENT DOCUMENTS 3,990,767 9/1976 Narozny ..... 339/198

4,190,952 3/1980 Thomas et al. ..... 29/629

*Primary Examiner*—Joseph H. McGlynn

*Attorney, Agent, or Firm*—Robert M. Rodrick; Salvatore J. Abbruzzese

[57] ABSTRACT

A connector for electrical connection of differently pitched electrical units, for example, flat multiconductor cable and a pin or socket-connector, includes a housing for supporting contact elements having end portions for respective joinder with the electrical units and a bendable central section. The housing includes interior structure, separate from its contact element support structure, for imposing prescribed bending attitudes upon the contact element central portions.

19 Claims, 12 Drawing Figures

PITCH TRANSITION CONNECTOR

This is a continuation of application Ser. No. 145,363, filed Apr. 30, 1980, now abandoned.

FIELD OF THE INVENTION

This invention relates generally to electrical connectors and pertains more particularly to connectors providing connection between conductive members of different pitch.

BACKGROUND OF THE INVENTION

Narozny U.S. Pat. No. 3,990,767, commonly assigned herewith, discloses a connector and connection scheme whereby a flat multiconductor cable may be mass-terminated for compatible connection at a pitch diverse from that of the cable pitch, i.e., the distance between centerlines of adjacent conductors. For flat cable in general commercial use, e.g., BLUE MACS® Flat Cable produced by T&B/Ansley Corporation, such pitch is 0.05 inch (1.27 mm). "D" type connectors, having contacts a 0.0545 inch (1.38 mm) pitch, are a particularly favored configuration for terminating flat cable.

In the '767 patent, pitch transition connector structure is shown wherein contacts are provided with one end portion adapted to pierce or displace flat cable insulation and engage a conductor, a second end portion opposite the first end portion and having pin or socket configuration and a bendable portion between the end portions. A plurality of such controls is disposed in a housing having first apertures for seating the contact first end portions at the flat cable pitch and second apertures for seating the contact second end portions at the D connector pitch. The bendable contact portions take on bending attitudes which accommodate such positioning of their end portions.

In present commercial practice, assembly of connectors implementing the connection scheme of the '767 patent involves the insertion of second end portions of contacts in a housing part (base) defining the second apertures above discussed and the conforming of the locations of the first end portions of contacts to that compatible with the flat cable pitch. A further housing part (insert), defining the first apertures above-discussed, is then secured to the base.

In such present practice, bending constraint, i.e., structure serving to conform attitudes of contact bendable portions to that desired, to avoid shorting of contacts and to permit correct pitch transition, is derived from base structure defining the second contact apertures, from insert structure defining the first aperture and from contact structure itself.

SUMMARY OF THE INVENTION

The present invention has, as its primary object, the provision of improved pitch transition connectors.

A more particular object of the invention is to provide pitch transition connectors having enhanced bending constraint and improved attitude control of contact bendable portions.

A further object of the invention is to provide improved practices for making and assembling pitch transition connectors.

In attaining the foregoing and other objects, the invention provides an electrical connector having base and insert defining contact end portion receiving apertures, contacts with end portions and bendable sections and bending constraint structure disposed at a location between opposed apertures and in registry with the contacts therein. In a preferred embodiment, connectors of the invention include bending constraints in both the base and insert and extending in parallel with the apertures.

By way of improved practice in assembling such connectors, contacts are placed with end portions in base apertures and with the contacts in registry with base bending constraints and the locations of opposed contact end portions are then conformed to that compatible with the flat cable pitch. Bending of contacts, which occurs in such locating of opposed contact end portions, thus is under constraint insuring at least fulcrum precision adjacent one contact end portion, by base bending constraint structure. Upon securement of the insert to the base, fulcrum precision is attained adjacent the remaining contact end portion, by insert bending constraint structure. Attitudes of bent contact portions extending between the fulcrums are accordingly controlled.

The foregoing and other objects of the invention will be further evident from the following detailed description thereof and from the drawings wherein like reference numerals identify like parts throughout.

DETAILED DESCRIPTION OF PREFERRED EMBODIMENTS AND PRACTICES

Figure 1:
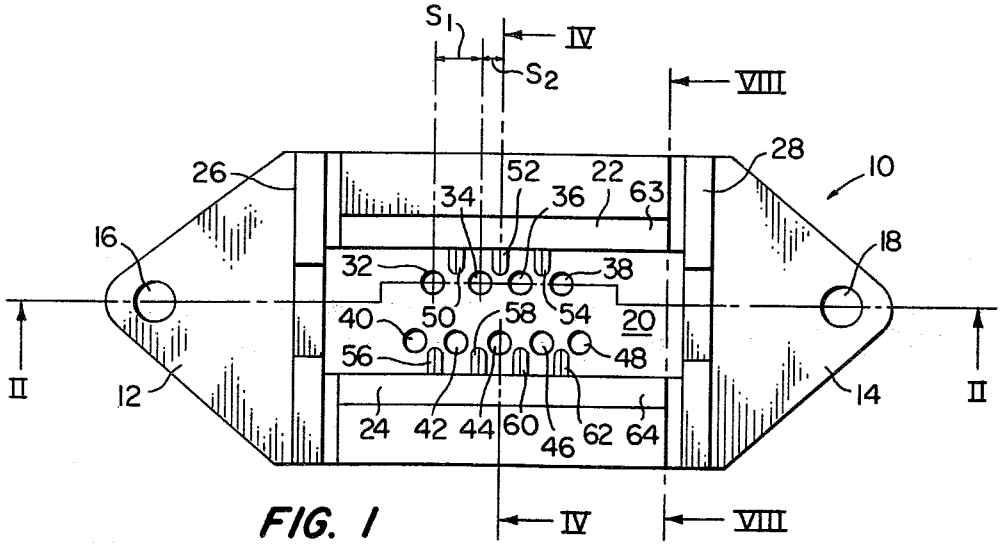
FIG. 1 is a plan elevational view of a connector base in accordance with the invention.
Figure 2:
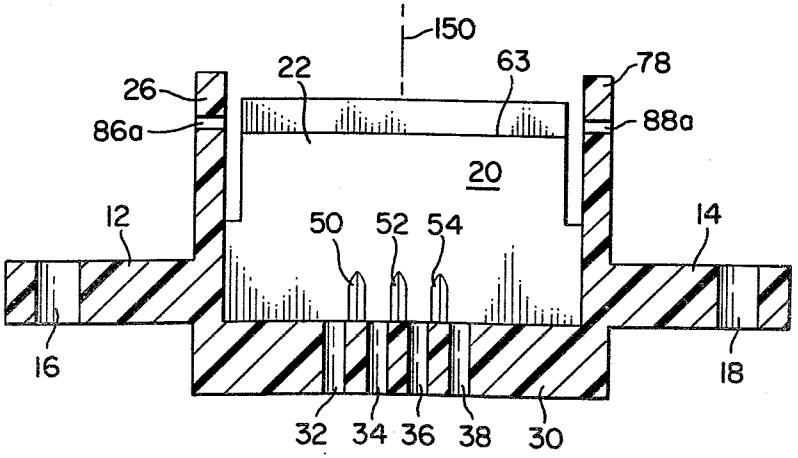
FIG. 2 is a sectional front elevational view as seen along plane II—II of FIG. 1.
Figure 3:
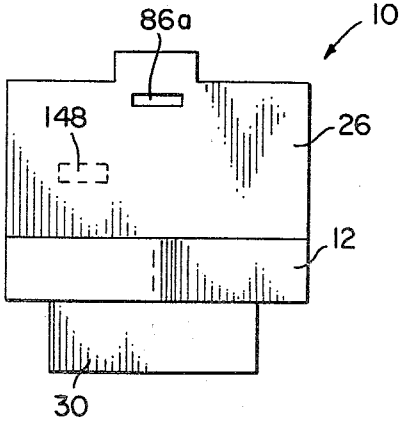
FIG. 3 is a side elevation of the base of FIG. 1.
Figure 4:
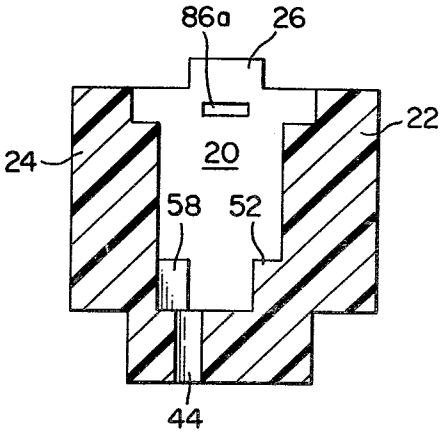
FIG. 4 is a sectional side view of the FIG. 1 base as seen along plane IV—IV of FIG. 1.

Referring to FIGS. 1–4, base 10 of a pitch transition connector in accordance with the invention is preferably comprised of molded plastic material throughout and includes side flanges 12 and 14 respectively, having mounting apertures 16 and 18. An insert-receiving cavity 20 is situated centrally in base 10 and bounded by rear wall 22, front wall 24 and side walls 26 and 28. At its lowermost portion, base 10 includes a transversely extending support 30, providing a floor for cavity 20 and defining contact end portion-receiving apertures 32–48, extending therethrough. Rear wall 22 has posts 50–54 extending outwardly thereof in the direction of apertures 32–38, such posts constituting bending constraints for contacts, as is discussed below. Front wall 24 has posts 56–62 extending outwardly thereof in the direction of apertures 40–48 and also providing contact bending restraint. Walls 22 and 24 further include lands 63 and 64 for purposes discussed below.

As will be recognized by those faimilar with D connectors, the base configuration of FIGS. 1–4 is that of a nine-contact D connector with apertures 32–38 being staggered with respect to apertures 40–48 longitudinally of elongate base 10. In accordance with the invention, like staggering is applied as between posts 50–54 and posts 56–62. Longitudinal spacing $S_1$ between center lines of adjacent apertures is twice the staggering spacing $S_2$. Like spacing exists between adjacent posts and in staggering the posts. Thus, as is best noted in the sectional view of FIG. 4, post 52 is in transverse registry with aperture 44, both appearing in section, whereas post 58 appears solid and not in section and aperture 34, opposite post 58 does not appear in FIG. 4.

Figure 7:
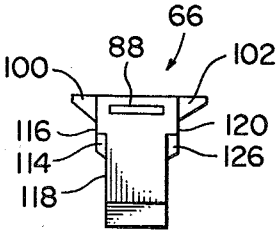
FIG. 7 is a side elevational view of the FIG. 5 insert.
Figure 5:
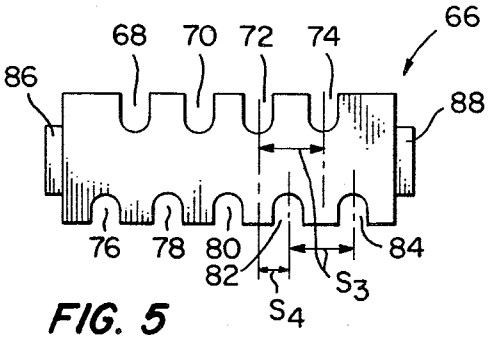
FIG. 5 is a plan elevational view of an insert for securement to the FIG. 1 base.
Figure 6:
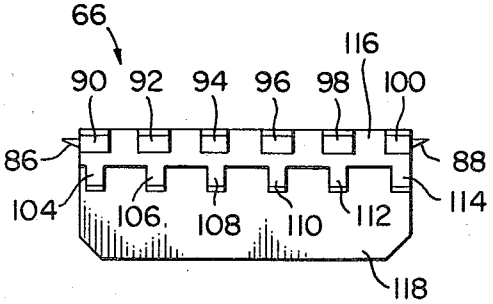
FIG. 6 is a front elevational view of the FIG. 5 insert.

Referring now to FIGS. 5–7, insert 66 has sideward openings 68–74, corresponding to base apertures 32–38 and further sideward apertures 76–84, corresponding to base apertures 40–48. The spacing $S_3$ between adjacent insert apertures is again twice the staggering distance $S_4$ between opposed sets of apertures. Lugs 86 and 88 extend outwardly from opposite ends of insert 66 and are registerable with apertures **86*a* and 88*a* (FIGS. 2–4) for latching the insert into the base. Insert apertures 76–84 are defined by projections 90–100, aperture 68 being bounded by projections 90 and 92, etc. A flat surface 116 flows downwardly of projections 90–100 in a plane common with the outer surfaces of posts 104–114. The posts return inwardly to insert flat surface 118 which extends downwardly therebelow and also in between adjacent ones of insert posts of 104–114**.

Figure 8:
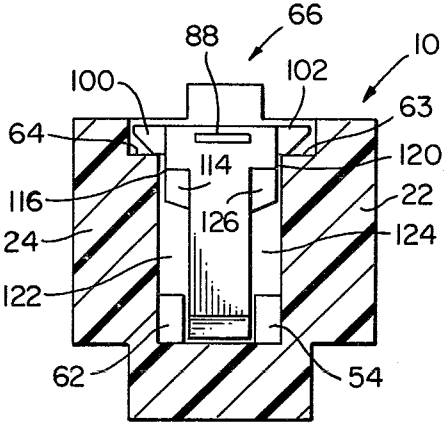
FIG. 8 is a sectional side view of the FIG. 1 base as seen along plane VIII—VIII of FIG. 1, with the FIG. 5 insert being shown unsectioned and in position in the base.

FIG. 8 is a side sectional view of base 10 as seen along plane VIII—VIII of FIG. 1, with insert 66 seated in base 10. For convenience of illustration and discussion, contacts (FIGS. 9–10) are omitted from the FIG. 8 showing. As will be seen, insert projections 100 and 102 register respectively with lands 64 and 63 of base 10. Some clearance exists between insert flat surfaces 116 and 120 and base walls 24 and 22, respectively. Post 114 of insert 66 and post 62 of base 10 are disposed in a common plane transverse to the plane of FIG. 8, such that they are in vertical registry in FIG. 8 but staggered along the longitudinal axis of base 10. Longitudinal open channels 122 and 124 accordingly extend with such axis of base 10, channel 122 being bounded vertically by insert posts 104–114 and base posts 56–62 and channel 124 being mounted vertically by insert post 126 (and adjacent posts not shown) and base posts 50–54.

Figure 10:
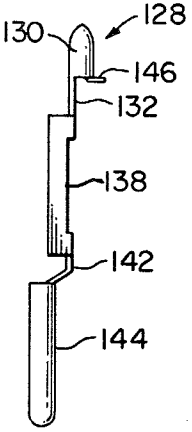
FIG. 10 is a side elevation of the FIG. 9 contact.
Figure 9:
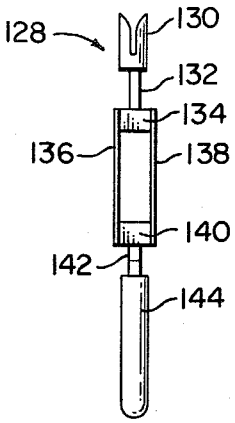
FIG. 9 is a front elevational view of a contact for use in practicing the invention.

Referring to FIGS. 9 and 10, contact element 128 is of particularly preferred configuration for use in practicing the invention. The contact element comprises an upper end portion 130 adapted for piercing flat cable insulation and engaging flat cable conductors and is shown particularly in U.S. Pat. No. 3,964,816 to which incorporating reference is hereby made. A necked-down portion 132 extends below end portion 130 and expands into a widened stem 134. Struts or beam members 136 and 138 extend downwardly from stem 134 and are secured thereto. At the lower ends of beams 136 and 138 a further stem 140 is secured to the beams, there being a further necked-down portion 142 extending below stem 140 and supporting lower contact end portion 144, shown in this instance as being of pin configuration. The central portion of contact element 128 is of bendable character, as set forth in U.S. Pat. No. 3,990,767, above-referenced and incorporated herein and also pertaining to pitch transition connection. FIG. 10 illustrates particularly the sideward configuration of contact element 128 and further indicates the provision of a placement element or lip 146 at the base of contact end portion 130.

Figure 11:
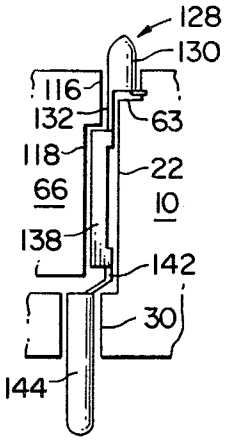
FIG. 11 is an illustrative view showing the FIG. 9 contact in assembly with base and insert.

FIG. 11 shows the manner of residence of contact element 128 in the assembly of base and insert, repeating the rightward portion of FIG. 8 for this purpose. As will be seen in FIG. 11, land 63 of base 10 supports contact end portion 130 and lip 146 piercingly engages base sidewall 22. Pin end portion 144 resides in a base aperture and extends therebeyond for electrical connection purposes. As respects insert 66, the contact necked-down portion 132 is in facing relation to insert flat surface 116 and insert flat surface 118 is recessed leftwardly of surface 116 to be in facing relation to the bendable central portion of the contact element.

Figure 12:
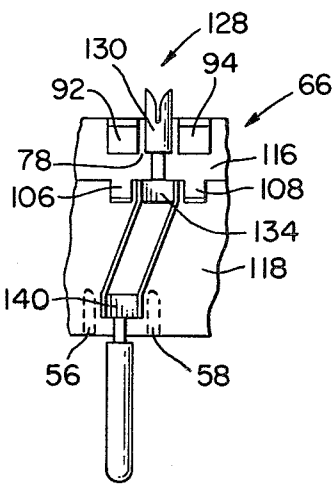
FIG. 12 is an illustrative view showing the FIG. 9 contact in bend orientation imposed by the base and insert upon joinder.

FIG. 12 is further illustrative of the manner of residence of contact element 128 in assembly with the base and insert. For convenience of description, the base is shown only by way of base posts 56 and 58, shown in broken lines. A portion of insert 66 is shown inclusive of projections 92 and 94 and posts 106 and 108. Contact end portion 130 is disposed in registry with projections 92 and 94 in insert aperture 78. Stem 134 and the extents of struts 136 and 138 adjacent stem 134 are in registry with posts 106 and 108. The posts conform attitudes of such strut extents to vertical attitudes and conform locations of bending, i.e., the upper fulcrum of each strut to that illustrated. Base posts 56 and 58 are likewise effective to conform attitudes of strut extents secured to stem 140, which are in registry with posts 56 and 58 to vertical attitudes and conform locations of bending, i.e., the lower fulcrum of each strut to that illustrated. With such constraint imposed by post structure on spaced portions of the contact element and staggered locations of residence of such constrained portions provided by insert and base apertures, a prescribed bend attitude accordingly is imposed upon the bendable central portion of the contact element.

As is customary in the art of mass-terminating flat cable, base 10 as assembled with contacts 128 and insert 66, and is further assembled with a connector top (not shown). The flat cable to be terminated is placed in the opening between the connector top and the remainder of the connector and a suitable bench press or hand tool forces the connector top down upon the flat cable, in turn providing for entry of contact end portions 130 into the cable for insulation displacement-piercing purposes and electrical connection between conductors of the cable and contact elements 128. Base 10 may typically include in its side walls a latching recess for receipt of the connector top, latching recess 148 being shown in phantom on side wall 26 in FIG. 3. Strain relief lids may further be assembled with the connector and retained by the base, as is also customary in the art.

In an improved assembly practice in accordance with the invention, the contacts are placed with end portions in base apertures and with the contacts in registry with the base bending constraint members. Prior to insert assembly, the locations of opposed contact end portions are now conformed by suitable positioning apparatus, to locations corresponding to the flat cable pitch. In the course of such location of the insulation-piercing contact end portions, the contacts are bent, in their central bendable portions, however, with fulcrum definition being provided outwardly of the base apertures by the bending constraint members. The insert is now secured to the base, whereupon fulcrum precision is attained adjacent the insulation-piercing contact end portions, again outwardly of the insert apertures.

By way of summary of the foregoing and in introduction of the appended claims, the invention will be seen to provide an electrical connector having a housing, preferably comprised of a separable base and insert, the housing defining one set of apertures mutually spaced by one distance and an opposed second set of apertures mutually spaced at a second distance different from the first distance, e.g., apertures 76–84 spaced by distance $S_3$ and apertures 40–48 spaced by distance $S_1$. First and second sets of bending constraint members, 104–114 and 56–62 are also in opposing relationship, defining an open channel 122 (FIG. 8) therebetween. When the housing is viewed as being upstanding, the aperture sets are vertically spaced and the bending constraint member sets are vertically spaced, both the apertures and the bending constraint members being horizontally successive. The assembly further includes contact elements having opposed end portions disposed in the opposed apertures and a bendable portion extending between the end portions, the constraint members so registering with the bendable portion as to conform its bend to a preselected bend attitude. An insertion axis 150 (FIG. 2) may be said to exist where the housing is comprised of base and insert and, upon assembly of base, contact elements and insert, the succession of parts along the insertion axis is insert apertures, bending constraint means and base apertures. As is noted, the bending constraint means preferably comprises separate bending constraint members on the base and insert. Referring to FIG. 8, bending constraint members 114 and 62 reside in a common plane parallel to the insertion axis, as is the case also for bending constraint members 126 and 54.

Otherwise considered, the invention will be seen to provide, in pitch transition connectors, housing structure separate from that defining contact element support for controlling bend disposition of contact elements. Thus, bending constraint structure is introduced in the housing separately from housing apertures receiving contact element end portions.

Various modifications of the foregoing structure and practice will now be evident to those skilled in the art. For example, the connector structure may be readily expanded to accommodate different-sized D connectors having expanded numbers of contact elements and to other connector structures. Various substitute structures will also be seen for the particularly shown bending constraint posts and for the preferred contact element. Accordingly, the particularly preferred embodiments and practices are intended in an illustrative and not in a limiting sense. The true spirit and scope of the invention is set forth in the appended claims.

What is claimed is:

1. An electrical connector, comprising:

a housing defining first apertures mutually spaced in a first housing portion by one distance and opposed second apertures mutually spaced in a second housing portion by a second different distance, said first and second housing portions being separable, first and second sets of contact bending constraint posts being located respectively on said first and second housing portions adjacent said first and second apertures and extending therebeyond, said housing defining an open channel separating said first set of constraint posts and said second set of constraint posts; and a plurality of contact elements, each having opposed end portions respectively disposed in ones of said first and second apertures and a bendable portion extending between said end portions, said first and second sets of constraint posts conforming the bend of said bendable portion to a preselected bend attitude.

2. The connector claimed in claim 1 wherein each said contact element includes an insulation-displacing contact in one end portion thereof.

3. The connector claimed in claim 1 wherein said first housing portion comprises an insert defining said first apertures and said second housing portion comprises a base defining said second apertures, said base defining a cavity for receiving said insert along an insertion axis through said base.

4. The connector claimed in claim 3 wherein said insert comprises said first set of bending constraint posts and said base defines said second set of bending constraint posts.

5. The connector claimed in claim 4 wherein said insert apertures, said first set of bending constraint posts, said second set of bending constraint posts and said base apertures are successively located along said insertion axis.

6. The connector claimed in claim 4 wherein plural of both said first set of constraint posts and said second set of constraint posts are located in a common plane parallel to said insertion axis.

7. The connector claimed in claim 6 wherein said first set of constraint posts and said second set of constraint posts are mutually staggered in said common plane.

8. An upstanding electrical connector, comprising:

a housing defining a plurality of contact receiving first apertures spaced horizontally apart at a first distance, a first set of contact bending constraint posts adjacent said first apertures extending vertically upward therebeyond; an insert for interconnection with said housing including a plurality of contact receiving second apertures spaced horizontally apart at a second distance, different from said first distance, a second set of contact bending constraint posts adjacent said second apertures extending vertically downward therebeyond; said housing and interconnected insert defining an open channel vertically between said first and second sets of constraint posts; and a plurality of contact elements each having a first end portion in one of said first apertures, a second end portion in one of said second aperture and a bendable portion extending between said first and second end portions.

9. The connector claimed in claim 8 wherein each said contact element includes an insulation-displacing contact in one end portion thereof.

10. The connector claimed in claim 8 wherein plural of both said first set of constraint posts and said second set of constraint posts are located in a common vertical plane.

11. The connector claimed in claim 10 wherein said first set of constraint posts and said second set of constraint posts are mutually staggered in said common vertical plane.

12. An electrical connector, comprising:

a plurality of contact elements, each having first and second end portions and a bendable portion extending between said end portions; and a housing having first support structure for receiving said first contact element end portions and second support structure for receiving said second contact element end portions such first end portions being mutually spaced differently than such second end portions, said first support structure and said second support structure being movable relative to each other, said first support structure having a first set of constraint posts and said second support structure having a second set of constraint posts, said first and second constraint posts conforming the attitudes of said plurality of contact element bendable portions to preselected attitudes upon relative movement of said first and second support structures.

13. The connector claimed in claim 12 wherein each said contact element includes an insulation-displacing contact in one end portion thereof.

14. The connector claimed in claim 12 wherein said housing comprises an insert defining said first support structure and a base defining said second support structure, said base defining a cavity for receiving said insert along an insertion axis through said base.

15. The connector claimed in claim 14, wherein said insert comprises said first set of bending constraint posts and said base defines said second set of bending constraint posts, such constraint posts constituting said further housing structure.

16. The connector claimed in claim 15 wherein said insert apertures, said first set of bending constraint posts, said second set of bending constraint posts and said base apertures are successively located along said insertion axis.

17. The connector claimed in claim 15 wherein plural of both said first set of constraint posts and said second set of constraint posts are located in a common plane parallel to said insertion axis.

18. The connector claimed in claim 17 wherein said first set of constraint posts and said second set of constraint posts are mutually staggered in said common plane.

19. An electrical connector, comprising:

a housing including a pair of oppositely facing longitudinal front walls, a pair of oppositely facing side walls transverse to said longitudinal walls, a base extending between said pairs of longitudinal and transverse walls;

a plurality of first apertures extending through said base, spaced apart at a first distance;

a plurality of first bending constraint members integrally formed and inwardly extending from said longitudinal walls, adjacent said base at intervals midway between a pair of said first apertures;

an insert member for interconnection with said housing including a body portion having a top surface and front and side walls in mating relation with said pairs of longitudinal and transverse walls;

a plurality of second apertures through said top surface spaced-apart at a second distance, different from said first distance;

a plurality of second bending constraint members outwardly extending from said insert front walls adjacent said top midway between a pair of said second apertures;

means including said insert side walls for interconnecting said insert and said housing; and a plurality of contact elements, each having opposed end portions respectively disposed in ones of said first and second apertures and bendable portion extending between said end portions, said first and second bending constraint means conforming the bend of said bendable portion to a preselected bend attitude.

* * * * *